US006338440B1

(12) United States Patent
Hörner

(10) Patent No.: US 6,338,440 B1
(45) Date of Patent: Jan. 15, 2002

(54) PROCEDURE FOR FEEDING OF POWDER-LIKE SUBSTANCES TO A DISCHARGING MEANS AND DEVICE FOR PERFORMING THE PROCEDURE

(75) Inventor: Berndt Hörner, München (DE)

(73) Assignee: Medprint Apparatebau GmbH, Grafing (DE)

( * ) Notice: Subject to any disclaimer, the term of this patent is extended or adjusted under 35 U.S.C. 154(b) by 0 days.

(21) Appl. No.: 09/507,069

(22) Filed: Feb. 18, 2000

Related U.S. Application Data

(63) Continuation of application No. PCT/EP98/05265, filed on Aug. 19, 1998.

(51) Int. Cl.[7] ..... A62C 5/02

(52) U.S. Cl. ..... 239/8; 239/346; 239/365; 239/373; 239/654; 239/143; 222/195

(58) Field of Search ..... 239/8, 346, 364, 239/365, 373, 143, 654, 325, 705; 406/67, 68, 106, 142; 222/30, 195, 637

(56) References Cited

U.S. PATENT DOCUMENTS 5,213,271 A * 5/1993 Uribe et al. ..... 239/654
5,238,154 A * 8/1993 Zuriel ..... 239/654
5,615,830 A * 4/1997 Matsunaga et al. ..... 239/8
5,713,494 A * 2/1998 Kaiju et al. ..... 222/637

* cited by examiner

*Primary Examiner*—Kevin Shaver
*Assistant Examiner*—Dinh Q. Nguyen
(74) *Attorney, Agent, or Firm*—Richard L. Schwartz; James J. Murphy; Winstead Sechrest & Minick

(57) ABSTRACT

A method and a device for supplying powder to a scattering device, comprising a device for producing negative pressure, a device for producing excess pressure, a powder container for receiving a powder reserve, and a separating device which is located inside the powder container and which separates a quantity of the powder reserve from the remainder in the powder container. The excess pressure device is connected to an air supply device. When the excess pressure device allows the air to strike the quantity of powder which has been separated, the powder forms swirls. The negative pressure device is connected to the powder container in such a way that the swirling powder is conveyed out of the powder container and to the scattering device by the negative pressure.

23 Claims, 3 Drawing Sheets

PROCEDURE FOR FEEDING OF POWDER-LIKE SUBSTANCES TO A DISCHARGING MEANS AND DEVICE FOR PERFORMING THE PROCEDURE

CROSS REFERENCE TO RELATED APPLICATION

This application is a continuation of International Application No. PCT/EP98/05265, filed Aug. 19, 1998.

FIELD OF THE INVENTION

The present invention relates to a procedure for feeding of powder-like substances to a discharging means and in particular to feeding of powder-like substance onto a flat product as, for example, a sheet of paper and a device for performing this procedure.

BACKGROUND

The present invention will be described in the following using the example of a powder duster for a printing machine. It must be pointed out that this procedure and device is also suitable for the feeding of powder-like substances in other technical fields and that the description of the invention with respect to a printing machine does not in any way signify a restriction of the application of the present invention.

To further simplify, the printed products are designated as sheets; this fact as well shall not signify a restriction and encompasses all types of printable products and objects.

In printing machines of the type referred to here, printed sheets are conveyed at relatively high speed onto a stack. At output speeds of 2 to 3 sheets per second and higher, the danger exists that the printed color may not have completely dried before the next sheet is conveyed onto the stack. When this happens, some of the printed color adheres to the reverse side of the next sheet, resulting thereby in an unusable product. In order to avoid such circumstances, the printed surfaces are dusted with powder by means of a powder dusting device. The powder employed prevents the adhering of a successive sheet to the previous sheet.

A powder duster having a powder receptacle arranged at its top is known from U.S. Pat. No. 5,615,830. The bottom of said powder receptacle has an opening under which a transporting drum or a conveyer belt disposed with cavities is provided for the receipt and transport of powder. Received powder is conveyed into a separate chamber in which an air feed and an air discharge outlet is provided. The powder swirled up by means of the horizontal air feed is then conveyed further through the likewise horizontal air discharge outlet.

The discharging of the powder onto the paper must transpire with high precision. Should too little powder be introduced, the desired effect will not be achieved and the printed product will be unusable.

Should too much powder be introduced, an undesirable high consumption of the material ensues as well as the danger arising that the powder will be applied unevenly. Should an uneven introduction of powder occur on a plurality of identical sheets, one end of the stack will end up higher than the other end and will slide off.

The operators of such printing machines expect that their operation will transpire automatically and largely without need for control over a period of several hours. The powder feeding means must therefore be so configured that it will function reliably without malfunction.

Powder atomizers are typical auxiliary devices for printing machines. For the buyer, the cost of such an accessory device must be in an acceptable ratio to the end price of the machine, so that the buyer's available financial resources, in particular with reasonably priced printing machines, is very limited.

SUMMARY OF THE INVENTION

Taking the above-mentioned considerations as a starting point, it is therefore the task of the present invention to provide a procedure and a device for feeding of powder to a powder discharging means which is reliable and which will function flawlessly over a longer period of time and which can nevertheless be manufactured at reasonable cost.

The procedure according to the present invention, the inventive device respectively, is configured in such a manner that a powder receptacle is provided connected to a vacuum means. A partitioning means is arranged within the powder receptacle for separating a portion of the powder from the remaining quantity of powder in said receptacle.

An air outlet device is arranged such that it feeds air to the separated quantity of powder in such a manner that the powder is swirled upwards by this emitted air.

The vacuum means simultaneously generates a vacuum effective within the powder receptacle which induces the air with the swirling powder to be sucked up and fed to the discharging means through suitable conduits, etc.

The inventive configuration of the procedure and device has considerable advantages compared to the state of the art.

Machine operators want to have as large of a powder reserve as possible at their disposal. A large reserve of powder however necessitates a correspondingly large reserve container. Since the quantity of powder within the powder receptacle changes during operation, the flow ratio also changes, whereby the amount of the swirled up powder and thereby the powder concentration changes in the siphoned-off air flow. In contrast thereto, the partitioning of a quantity of powder from the total quantity induces that the air flow effects only a small portion of the powder quantity and that thereby the swirled up quantity is no longer, or only in small measure, dependent upon the fill capacity of the powder in the powder receptacle.

In accordance with a preferred embodiment, the powder receptacle is arranged essentially perpendicular, whereby the air siphoning device is then preferably disposed above the receptacle.

The partitioning means preferably constitutes a chamber which, with a vertically disposed powder receptacle, is open, at least partially, at its upper end and at its bottom end.

The powder receptacle is preferably configured rotation symmetrical whereby the axis of rotation is essentially perpendicular and the chamber is then preferably likewise configured such that its longitudinal axis coincides with said rotational axis.

The chamber is likewise preferably configured rotation symmetrical whereby then both the rotation symmetrical axes of receptacle and chamber coincide with one another.

The chamber is preferably configured in cyclone or funnel or tapered shape; i.e. its extension in cross-section, meaning as seen horizontally, diminishes downwardly.

The air feed device is preferably aligned with respect to the partitioning means, respectively the chamber wall which it forms, such that the air flow initially impacts the chamber wall before being deflected from this point onto the powder.

In accordance with a preferred embodiment of the present invention, should such a need arise, for a device configured without the powder receptacle having a partitioning means, the device according to the present invention further comprises a refilling means.

When conventional powder receptacles have to be refilled, the powder receptacle must be removed, filled with powder and then put back on. The running of the corresponding machine must of course be stopped during the time this process takes.

In the powder receptacle of the embodiment according to the present invention described herewithin, a reserve container is provided above the powder receptacle and is joined thereto by means of a corresponding locking means, preferably a locking valve.

Opening the valve allows powder to fill into the powder receptacle from the reserve container without the need for interrupting the operation of the machine.

In the present description, the formulation of the patent claims and in the following description, it is to be assumed that the matter to be conveyed is a powder and that the conveying medium is air. It is to be noted that the invention may also be applied with other matter to be conveyed which is perhaps not normally characterized as being of powder form, provided that the behavior of said matter in a flowing medium is similar to the herein described behavior of powder.

Furthermore. the transport medium is not solely limited to air. According to demand, another gas may be used, for example nitrogen, helium or other such gasses.

Especially preferable, however, is the utilization of the invention with powder which is suitable for dusting of newly printed products, powder such as calcium carbonate, for example, and which has a grain size between 5 and 100 $\mu$m, especially preferred between 15 and 50 $\mu$m.

Further advantages, characteristics and possible applications of the present invention will now be described in the following with respect to an embodiment and in reference to the drawing figures.

DETAILED DESCRIPTION OF PREFERRED EMBODIMENTS

Figure 1:
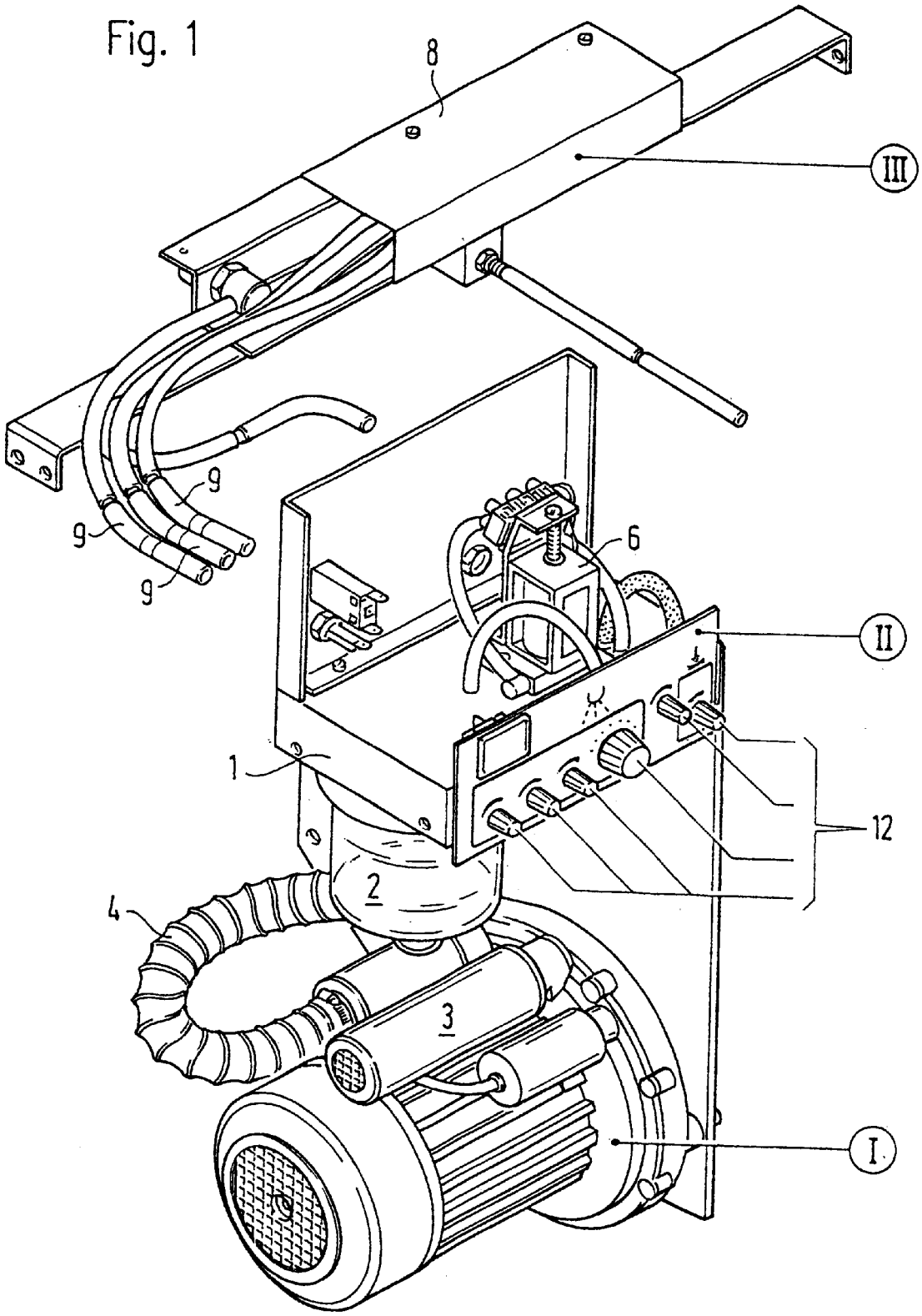
FIG. 1 illustrates the basic construction of a powder dusting device for printing machines in a perspective view, whereby individual structural components are shown separated from one another.

In FIG. 1, reference numeral I designates the fan device as a whole, reference numeral II designates a means for feeding of powder, and reference numeral III designates a means for discharging of powder onto a printed product The means for the feeding of the powder consists of a housing 1 onto which a powder container or receptacle 2 is affixed.

Fan 3 feeds air to the housing through hose 4. Part of the air is fed through a solenoid valve 6 into the powder tumbler in which the powder, as will later be discussed in detail, is then swirled around.

Another part of the air is conducted through a venturi nozzle, not shown in FIG. 1, generating a vacuum. Said vacuum sucks in the powder-air mixture formed in the powder receptacle and feeds it to the actual dusting device 8.

The feed to dusting device 8 transpires via hoses 9 which are connected to hose 4 and the powder receptacle via housing 1. The quantity of powder to be discharged is controlled by regulator 12.

Figure 2:
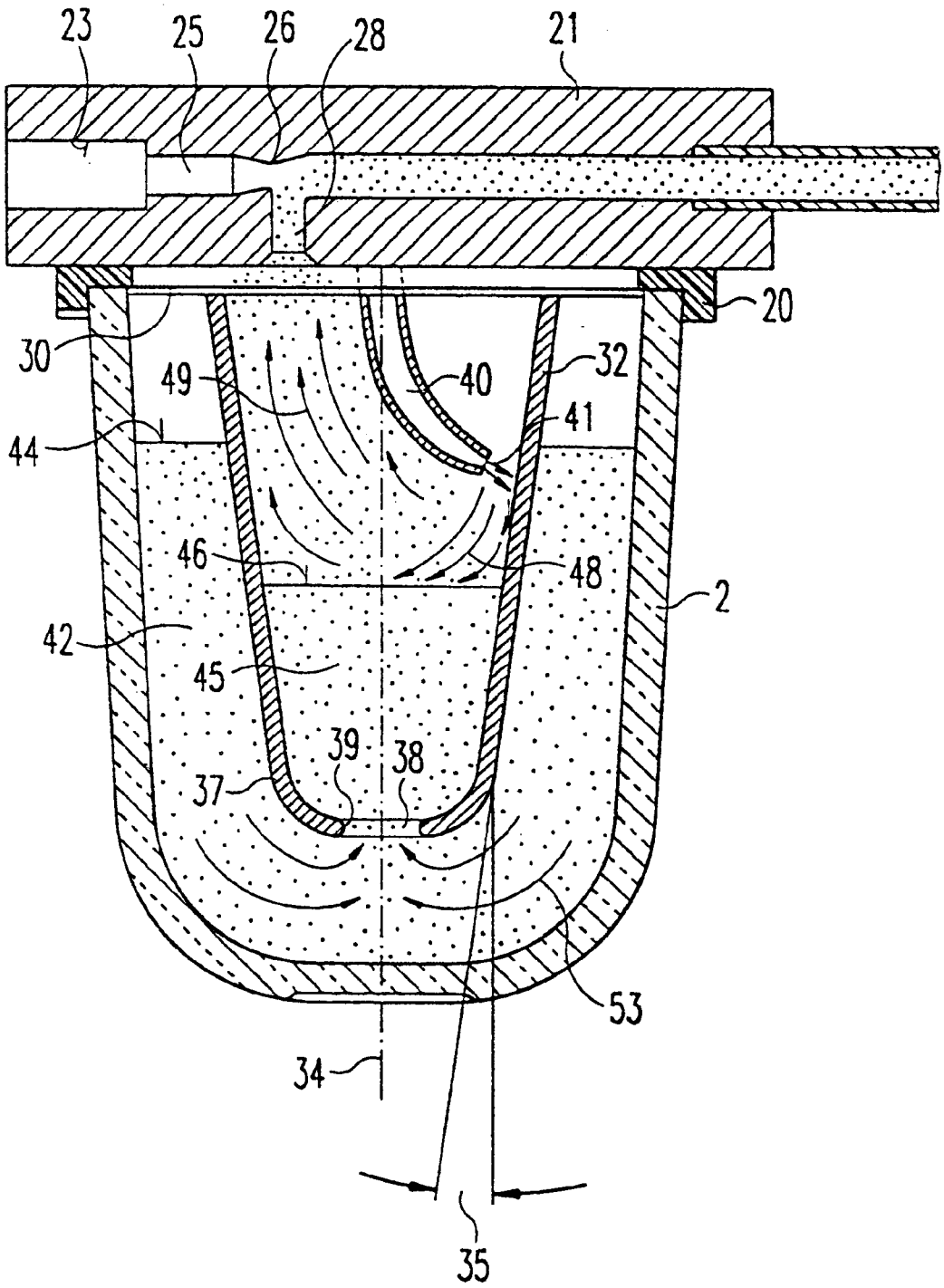
FIG. 2 illustrates a somewhat schematic representation of a feeding means for a powder dusting device according to FIG. 1.

FIG. 2 shows the actual powder feeding means. Powder tumbler receptacle 2 is connected via seal 20 with the floor of a housing 21 by means of a bayonet catch or a screw cap. An air feed bore 23 connects on one side to hose 4 and on the other side to a conduit 25 extending through the floor. Conduit 25 is disposed with a cross-sectional constriction 26 which acts as a venturi nozzle. An essentially perpendicular conduit 28, which connects to the powder tumbler or receptacle, is joined within the flow connection of the venturi nozzle.

A partitioning means 32 is arranged on a retainer 30, said partitioning means being made of metal, for example. Partitioning means 32 is configured rotation symmetrical to a rotational axis 34, which also represents the rotation symmetrical axis of the powder receptacle 2.

The individual profile of the partitioning means 32, just as the individual profile of the powder receptacle 2, is of annular shape.

The diameter of the partitioning means 32 in its upper region amounts to approximately ⅔ of the diameter of the powder receptacle 2 and tapers downwardly, The angle 35, FIG. 2, at which the wall of the partitioning means is inclined with respect to the vertical, is an angle in the range of preferably 2° to 20°, especially preferred is an angle range of between 5° and 10°.

The length of the partitioning means 32 is preferably configured such that it amounts to between 60% and 90% of the length of the powder receptacle 2, as measured in rotational axis direction, the range between 70% and 90% is especially preferred.

In its lower portion 37, the wall of the partitioning means 32 is curved inwardly and is in fact configured such that a bore 38 is arranged through which the partitioning means remains in contact with the interior of the powder receptacle 2.

The front ends 39 of the wall of said partitioning means 32 enclosing bore 38 are preferably of rounded off configuration.

An air inlet opening or feed device 40, which connects with the air feed hose 4 via the shown solenoid valve, projects into the interior of the partitioning means 32, whereby said air feed device 40 extends in curved configuration to the wall of the partitioning means and whereby the forward opening 41 of said air feed device 40 is configured such that the exiting air is blown against the wall.

The function of powder feeding means II is as follows:

To begin the feeding of the powder, the powder receptacle 2, which is preferably made of transparent glass, is removed from housing 21 and filled with powder 42. Then the receptacle is replaced, yielding the level of powder indicated by 44. A portion of the powder 42 has already been pressed into the partitioning means 32 upon putting the powder receptacle 2 back, thus forming the powder reserve 45. Powder reserve 45 has the height level indicated by 46.

Upon turning on the fan 3, air streams into flow conduit 23, and through venturi nozzle 26, thereby developing a vacuum in conduit 28.

Simultaneously, air streams through air feeding device 40, through nozzle opening 41, against the wall of the partitioning means 32, and swirls up the powder as represented by arrows 48.

The swirled-up powder is sucked through conduit 28 by the vacuum, as is indicated by arrows 49. The powder is swept along by the air stream entering nozzle 23 and conveyed through the hoses of the dusting device. The height level 46 of the powder in the partitioning means 32 is reduced due to powder being removed and conveyed out of the partitioning means. This reduction in height level is not compensated instantly; not until a fixed difference is reached between the height level 44 of the powder reserve and the height level 46 does the powder flow along the direction of arrows 53 from the powder receptacle 2 into the interior of the partitioning means 32.

Dependent upon the correspondingly selected configuration of the partitioning means 32; i.e. its diameter with respect to the diameter of the powder receptacle 2, the angle of inclination 35, the curvature 37 in its lower region, and the diameter of opening 38, the subsequent stream of powder quantity can be influenced in such a calculated manner that the level of powder within the partitioning means only changes within certain limits.

Alone the circumstance of the reduced volume in the interior of the partitioning means 32 in comparison with the total volume held in the powder receptacle 2 has the consequence that the quantity of powder swirled up by the air stream is essentially independent from the level of powder in the partitioning means. This renders an essentially constant amount of powder fed to the dusting device per unit of time; i.e., the air stream, meaning the volume of air entering the powder hoses, is essentially constant over time, and that the volume or the proportion of weight of the powder in this air stream likewise remains essentially constant. This has the consequence that the amount of powder introduced onto the printed sheet is essentially constant per unit of time and that this consistency can also be maintained for several hours.

The consistency to said fed amount of powder is even further improved in that the reduction of powder reserve in the powder receptacle does not influence or effect the level of powder in the partitioning means.

Figure 3:
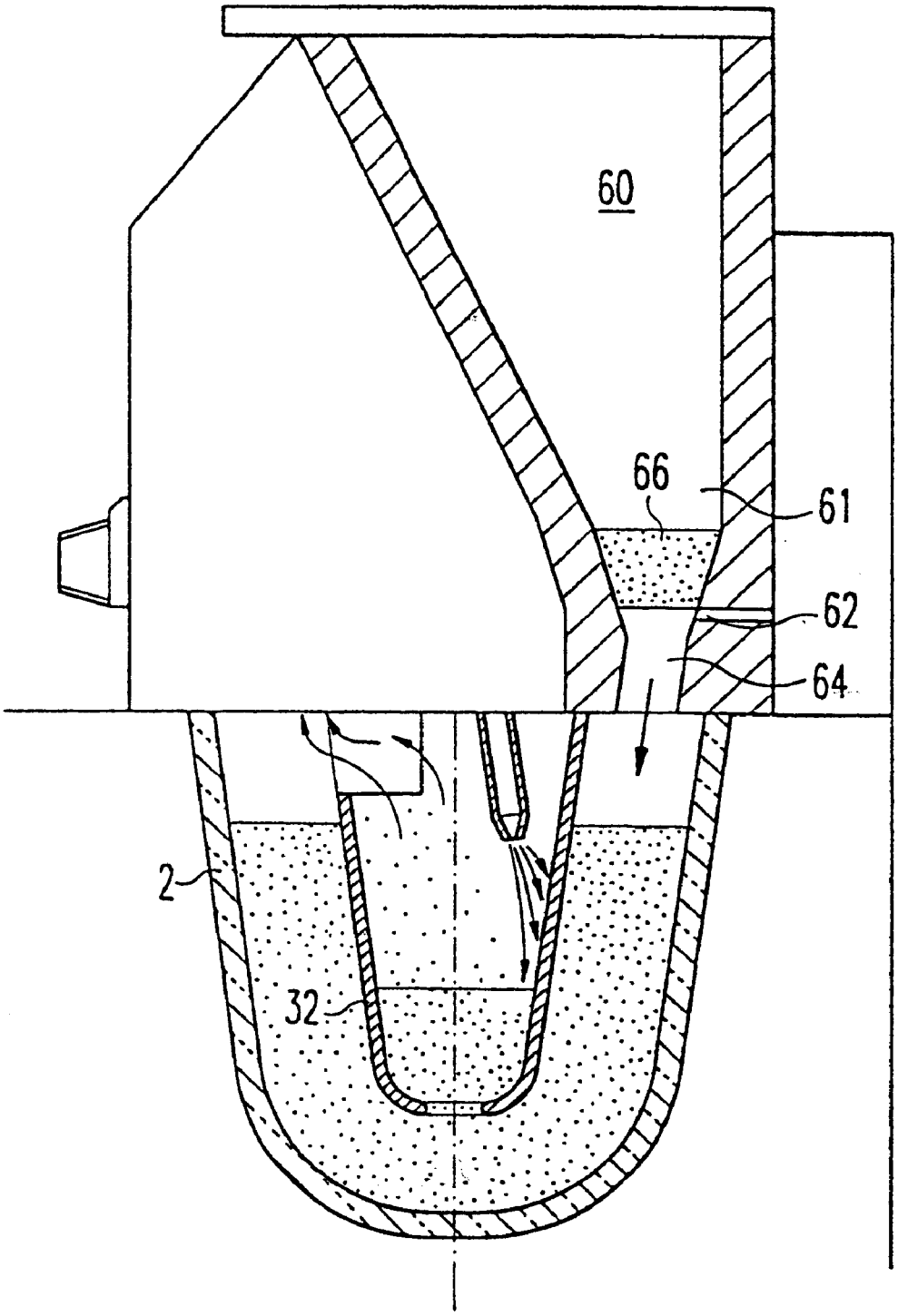
FIG. 3 illustrates another somewhat schematic representation of a feeding means according to FIG. 2 with a refilling container placed atop it.

A further embodiment of the present invention is represented schematically in FIG. 3. FIG. 3 depicts the lower portion of powder receptacle 2 with partitioning means 32. A reserve container 60 is arranged above powder receptacle 2, said container tapering downward into region 61 such that its width essentially corresponds to the difference of the radii between the powder receptacle and the partitioning means.

A valve means 62 is provided in this region (which is not shown in more detail in this drawing) which seals the bottom of the container. The interior of container 60 joins to flow conduit 64. A remaining fill level of powder in reserve container 60 is indicated by 66.

The function of reserve container 60 is as follows.

Valve means 62 is normally closed, so that the interior of powder receptacle 2 and the interior of reserve container 60 are not connected together. Therefore, reserve container 60 does not have any influence on the configuration of a vacuum in powder receptacle 2, or in partitioning means 32, respectively.

When an operator notes that the quantity of powder receptacle 2 is below a predetermined quantity, said operator opens valve 62, thereby creating a flow connection between the interior of container 60 and the interior of powder receptacle 2. Powder flows through this flow connection into powder receptacle 2 until the certain predetermined quantity level is reached and the operator closes valve means 62.

This activity just described can also be automated. In this case, at least a level sensor is to be provided in the powder receptacle 2 which reads the level of powder and emits an electrical signal representative thereof to a control means (not shown). Said control means then induces the opening of valve means 62, which in this case would be operated electrically or pneumatically, until the level in the powder receptacle 2 reaches its predetermined height. This level of height is also preferably read by a sensor, not shown, and a corresponding signal fed to the control means.

The utilization of such a reserve container has considerable advantages.

The reserve container 60 does not extend the interior of powder receptacle 2 so that the pressure ratio, and in particular the vacuum, is thereby not influenced. The usual procedure in refilling powder entails removing the powder receptacle and thereby shutting down the machine. The utilization of the reserve container as described herein requires only opening valve means 62. The pressure ratio in the powder receptacle 2, and in particular in the partitioning means 32, remains essentially unchanged during the exuding of powder into powder receptacle 2 so that the normal machine operation can be maintained.

When valve means 62 is closed, the powder can be filled into reserve container 60 without needing to stop the machine.

Due to the connection with the reserve container 60 it is thereby possible to realize a continuous operation of the dusting device.

Since due to the constructional configuration of printing machines, powder receptacles are customarily disposed in a machine's lower region, it is usually awkward for operators to remove and fill these containers. The utilization of such a reserve container as described herein enables powder to be filled from above in a simple manner.

What is claimed is:

1. A procedure for feeling of powder to a discharging means including a venturi nozzle for generating a vacuum, means for generating excess pressure, a powder receptacle provided for housing a powder supply, a partitioning means arranged within said powder receptacle and which separates a portion of said powder supply from the remaining powder supply in said powder receptacle, said procedure including:

connecting said means for generating excess pressure with an air feed device which allows air to impact upon at least a portion fan inner wall of said partitioning means and said separated portion of said powder and cause same to be swirled up; and connecting said venturi nozzle for generating a vacuum with said powder receptacle in such a manner that said vacuum induces the powder which is swirled up to be siphoned out of said powder receptacle and fed to said discharging means.

2. A procedure according to claim 1, characterized in that:

said vacuum is generated by fan air conducted through said venturi nozzle and said fan air is simultaneously used to supply powder to said discharging means.

3. A device for feeding of powder to a discharging means including:

means for generating a vacuum;

means for generating excess pressure air;

a powder receptacle for housing a powder supply; and a partitioning means arranged within said powder receptacle and which separates a portion of said powder supply from the remaining powder supply in said powder receptacle whereby said means for generating excess pressure is connected with an air feed device provided in said partitioning means, said air feed device feeding air in such a manner that at least a portion of said air impacts at least a portion of an inner wall of said partitioning means and whereby said means for generating a vacuum is connected with said powder receptacle in such a manner that the powder, which is swirled up by means of the air fed through the air feed device, is extracted from said powder receptacle.

4. A device according to claim 3 characterized in that:

said partitioning means constitutes a chamber having at least one opening which is in the flow connection with the interior of said powder receptacle.

5. A device according to claim 4, characterized in that:

said powder receptacle is essentially of rotation symmetrical configuration and said partitioning means is likewise of essentially rotation symmetrical configuration whereby the rotation symmetrical axes of said powder receptacle and said partitioning means coincide with one another.

6. A device according to claim 5, characterized in that:

the rotation symmetrical axis of said powder receptacle when in use is essentially of perpendicular alignment.

7. A device according to claim 4 characterized in that:

a powder reserve container is provided which is connectable with said powder receptacle via a flow conduit.

8. A device according to claim 7, characterized in that:

a valve means is provided which can be switched from a first position in which said flow conduit is closed into at least one second position in which said flow conduit is open.

9. A device according to claim 3 characterized in that:

said partitioning means comprises a chamber of changeable cross-section whereby, with a rotation symmetrical configuration of said partitioning means with a vertical rotation symmetrical axis, said chamber tapers downwardly.

10. A device according to claim 9 characterized in that:

said at least one opening is arranged in the bottom section of said partitioning means.

11. A device according to claim 10, characterized in that:

said air feed device is configured as an air feed hose having an air outlet opening arranged within said partitioning means.

12. A device according to claim 11, characterized in that:

said air outlet opening is arranged in such a manner that at least a part of the emitted air stream impacts against an inner wall of said partitioning means.

13. A procedure for feeding of powder to a discharging means including means for generating a vacuum, means for generating excess pressure, a powder receptacle provided for housing a powder supply, a partitioning means arranged within said powder receptacle and which separates a portion of said powder supply from the remaining powder supply in said powder receptacle whereby said partitioning means constitutes a chamber having at least one opening which is in the flow connection with the interior of said powder receptacle and which is open above and at least partially below, and that said powder receptacle is of rotation symmetrical configuration, whereby an air siphoning device is disposed above said powder receptacle, said procedure including:

connecting said means for generating excess pressure with an air feed device which allows air to impact upon said separated portion of said powder and cause same to be swirled up; and connecting said means for generating a vacuum with said powder receptacle in such a manner that said vacuum induces the powder which is swirled up to be siphoned out of said powder receptacle and fed to said discharging means.

14. A procedure according to claim 13 characterized in that:

said vacuum is generated in that fan air is conducted through a venturi nozzle and said fan air is simultaneously used to feed powder to said discharging means.

15. A device for feeding of powder to a discharging means including:

means for generating a vacuum;

means for generating excess pressure;

a powder receptacle for housing a powder supply;

a partitioning means arranged within, said powder receptacle and which separates a portion of said powder supply from the remaining powder supply in said powder receptacle, whereby said means for generating excess pressure is connected with an air feed device provided in said partitioning means and whereby said means for generating a vacuum is connected with said powder receptacle in such a manner that the powder, which is swirled up by means of the air fed through the air feed device, is extracted from said powder receptacle through an air siphoning conduit; and said partitioning means constitutes a chamber having at least one opening which is in the flow connection with the interior of said powder receptacle and which is open above and at least partially below and that said powder receptacle is of rotation symmetrical configuration, and said air siphoning conduit is disposed above said powder receptacle.

16. A device according to claim 15 characterized in that:

said powder receptacle is essentially of rotation symmetrical configuration and that said partitioning means is of essentially rotation symmetrical configuration whereby the rotation symmetrical axes of said powder receptacle and said partitioning means coincide with one another.

17. A device according to claim 16, characterized in that:

the rotation symmetrical axis of said powder receptacle when in use is essentially of perpendicular alignment.

18. A device according to claim 16, characterized in that:

a powder reserve container is provided which is connectable with said powder receptacle via a flow conduit.

19. A device according to claim 18 characterized in that:

a valve means is provided which can be switched from a first position in which said flow conduit is closed into at least one second position in which said flow conduit is open.

20. A device according to claim 15 characterized in that:

said partitioning means comprises a chamber whereby an extension of said chamber diminishes downwardly, and whereby with a rotation symmetrical configuration of the partitioning means with a vertical rotation symmetrical axis, said chamber tapers downwardly.

21. A device according to claim 20, characterized in that:

said at least one opening is arranged in a bottom section of said partitioning means.

22. A device according to claim 21, characterized in that:

said air feed device is configured as an air feed hose having an air outlet opening arranged within said partitioning means.

23. A device according to claim 22, characterized in that:

said air outlet opening is arranged in such a manner that at least a part of the emitted air stream impacts against the inner wall of said partitioning means.

* * * * *

UNITED STATES PATENT AND TRADEMARK OFFICE

CERTIFICATE OF CORRECTION

PATENT NO. : 6,338,440 B1
DATED : January 15, 2002
INVENTOR(S) : Horner

It is certified that error appears in the above-identified patent and that said Letters Patent is hereby corrected as shown below:

Title page,
Item [73], Assignee: -- Mediprint Apparatebau GmbH, Grafing (DE) --

Signed and Sealed this

Third day of September, 2002

*Attest:*

*Attesting Officer*

JAMES E. ROGAN
*Director of the United States Patent and Trademark Office*